US007803288B2

(12) United States Patent
Hayashi et al.

(10) Patent No.: US 7,803,288 B2
(45) Date of Patent: Sep. 28, 2010

(54) NEUTRON SHIELDING MATERIAL COMPOSITION, SHIELDING MATERIAL AND CONTAINER

(75) Inventors: Noriya Hayashi, Nagoya (JP); Yoshiyuki Tasaka, Yokohama (JP); Nobuo Ishihara, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 171 days.

(21) Appl. No.: 10/588,331

(22) PCT Filed: Feb. 4, 2004

(86) PCT No.: PCT/JP2004/001119

§ 371 (c)(1),
(2), (4) Date: Aug. 31, 2007

(87) PCT Pub. No.: WO2005/076288

PCT Pub. Date: Aug. 18, 2005

(65) Prior Publication Data

US 2008/0039566 A1 Feb. 14, 2008

(51) Int. Cl.

| | |
|---|---|
| ***G21F 1/00*** | (2006.01) |
| ***G21F 1/10*** | (2006.01) |
| ***G21F 1/12*** | (2006.01) |
| ***G21C 7/24*** | (2006.01) |

(52) U.S. Cl. ..... 252/478; 250/515.1; 250/518.1; 250/505.1; 524/404; 264/239; 264/299

(58) Field of Classification Search ..... 324/754, 324/761; 81/59.1; 524/404; 376/272; 250/518.1, 250/515.1, 484.4, 505.1; 523/445; 264/239, 264/299

See application file for complete search history.

(56) References Cited

U.S. PATENT DOCUMENTS

| | | | | |
|---|---|---|---|---|
| 5,700,962 | A * | 12/1997 | Carden | 75/236 |
| 7,327,821 | B2 * | 2/2008 | Ishihara et al. | 376/272 |
| 2003/0102445 | A1 * | 6/2003 | Kamoshida et al. | 250/507.1 |
| 2008/0035891 | A1 * | 2/2008 | Hayashi | 252/478 |

FOREIGN PATENT DOCUMENTS

| | | | |
|---|---|---|---|
| EP | 0 628 968 | A1 | 12/1993 |
| EP | 1 316 968 | A1 | 4/2003 |
| EP | 1 316 968 | A2 | 4/2003 |

(Continued)

OTHER PUBLICATIONS

Machine translations of JP 2004-061463 and JP 2003-050295.*

(Continued)

*Primary Examiner*—Vasu Jagannathan
*Assistant Examiner*—Hannah Pak
(74) *Attorney, Agent, or Firm*—Trop, Pruner & Hu, P.C.

(57) ABSTRACT

A neutron shield material that exhibits high heat resistance and ensures neutron shielding capacity. A composition for neutron shield material excelling in heat resistance and ensuring neutron shielding capacity is provided by comprising a hydrogenated bisphenol type epoxy of the formula: (1) (wherein each of $R_1$ to $R_4$ is independently selected from the group consisting of $CH_3$, H, F, Cl and Br, and n=0 to 2), a hardening agent component having at least one cyclic structure and two or more amino groups, a density increasing agent and a boron compound.

11 Claims, 2 Drawing Sheets

FOREIGN PATENT DOCUMENTS

| | | | |
|---|---|---|---|
| EP | 1 600 984 | A1 | 11/2005 |
| JP | 60-194394 | A1 | 10/1985 |
| JP | 6-148388 | A1 | 5/1994 |
| JP | 9-180389 | A1 | 6/1994 |
| JP | 2001-108787 | A | 4/2001 |
| JP | 2001-116885 | A1 | 4/2001 |
| JP | 2003-50295 | A1 | 2/2003 |
| JP | 2003-66189 | A1 | 3/2003 |
| JP | 2004-61463 | A1 | 2/2004 |
| WO | WO 99/00462 | A1 | 1/1999 |

OTHER PUBLICATIONS

Smith. "Can Magnesium Be Extracted from Seawater." WiseGEEK. pp. 1-2, 2003.*

European Patent Office, Supplementary European Search Report, Oct. 8, 2008.

* cited by examiner

NEUTRON SHIELDING MATERIAL COMPOSITION, SHIELDING MATERIAL AND CONTAINER

TECHNICAL FIELD

The present invention relates to a neutron shielding material composition. Further, the present invention relates to an epoxy resin composition for a neutron shielding material. The material is applied to a cask as a container for storing and transporting a spent nuclear fuel, exhibits improved heat resistance and has ensured neutron shielding performance.

BACKGROUND ART

Nuclear fuels spent in nuclear facilities such as nuclear power plants are typically transported to reprocessing plants and then reprocessed. However, such spent nuclear fuels today are generated in an amount exceeding the reprocessing capacity. Thus, it is necessary to store spent nuclear fuels for a long period. In this case, spent nuclear fuels are cooled to a radioactivity level that makes the fuels suitable for transportation, and then placed in a cask as a nuclear shielding container and transported. Even at this stage, the spent nuclear fuels still emit radiation such as neutrons. Neutrons have high energy, and generate γ-rays to cause serious harm to the human body. For this reason, it is necessary to develop a neutron shielding material that can surely shield such neutrons.

Neutrons are known to be absorbed by boron. To make boron absorb neutrons, it is necessary to moderate the neutrons. Hydrogen is known to be most suitable as a substance for moderating neutrons. Accordingly, a neutron shielding material composition must contain a large amount of boron atoms and hydrogen atoms. Further, since spent nuclear fuels or the like as a neutron source generate decay heat, the fuels are exothermically subjected to a high temperature when sealed in a cask for transportation or storage. The highest temperature varies depending upon the types of spent nuclear fuels, however, it is said that the temperature of spent nuclear fuels for high burnup may reach about 200° C. in a cask. For this reason, a nuclear shielding material for use preferably endures under such high-temperature conditions for about 60 years as a reference storage period for spent nuclear fuels.

In this situation, use of a substance having a high hydrogen density, in particular, water as a shielding material has been proposed, and some of the proposals have been put into practice. However, water is difficult to be handled because it is a liquid, and is not suitable for a cask for transportation and storage, in particular. Moreover, when water is used, the internal temperature of a cask is 100° C. or more, and thus it is difficult to suppress boiling, disadvantageously.

For this reason, conventionally, a resin composition has been used as a material for a neutron shielding material, and an epoxy resin has been used in one of such resin compositions. Generally, there is a reciprocal relationship between hydrogen content and heat resistance in a resin composition. A resin composition having a high hydrogen content tends to have low heat resistance, and a resin composition having high heat resistance tends to have a low hydrogen content. An epoxy resin exhibits excellent heat resistance and curability, but tends to contain only a small amount of hydrogens indispensable for moderating neutrons. Therefore, an amine curing agent having a high hydrogen content has been conventionally used to compensate this drawback.

Japanese Patent Application Unexamined Publication No. 6-148388/1994 discloses a neutron shielding material composition containing a polyfunctional amine epoxy resin and having reduced viscosity for improving workability at ordinary temperature. The composition exhibits excellent pot life. Japanese Patent Application Unexamined Publication No. 9-176496/1997 discloses a neutron shielding material obtained by curing a composition comprising an acrylic resin, epoxy resin, silicone resin or the like with a polyamine curing agent. Sincethe amine has relatively high hydrogen content, the effect of moderating neutrons is improved. However, the amine moiety thereof is easily decomposed by heat. In addition, in order to compensate the lack of the hydrogen content in the epoxy component, a curing agent having a high hydrogen content but having rather lower heat resistance such as polyamine tends to be used, and the ratio of the curing agent component in the resin composition tends to be high. Accordingly, it has been demanded to develop a novel composition having sufficient durability necessary for storing a spent nuclear fuel for high burnup, rather than a conventional composition cured with an amine curing agent.

An object of the present invention is to provide a neutron shielding material composition which exhibits heat resistance more excellent than that of a conventional composition, and has ensured neutron shielding capability.

DISCLOSURE OF THE INVENTION

In order to achieve the above object, the present invention provides a neutron shielding material composition, comprising a hydrogenated bisphenol resin, a curing agent component, a boron compound and a density-increasing agent.

The present invention also provides a neutron shielding material composition, comprising a hydrogenated bisphenol epoxy represented by the structural formula (1):

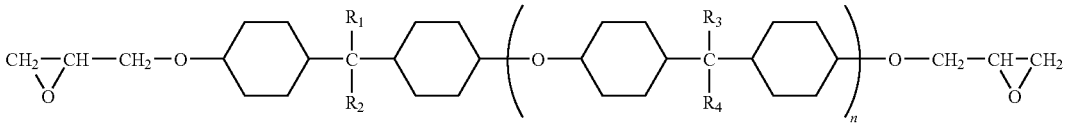

(1)

wherein each of $R_1$ to $R_4$ is independently selected from the group consisting of $CH_3$, H, F, Cl and Br, and n is from 0 to 2;

a curing agent component having at least one ring structure and a plurality of amino groups;

a boron compound; and a density-increasing agent.

The composition may preferably further comprise one or more compounds selected from the group consisting of compounds having the structural formulas (2), (3), (6), and (9):

(2)

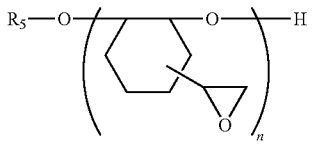

wherein $R_5$ is a $C_{1-10}$ alkyl group or H, and n is from 1 to 24;

(3)

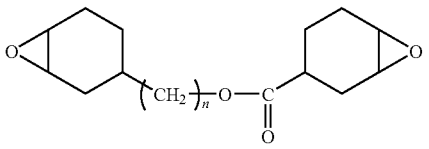

wherein n is from 1 to 8;

(6)

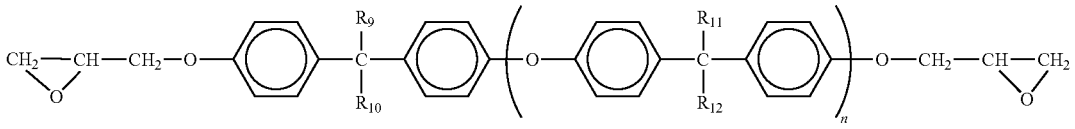

wherein each of $R_9$ to $R_{12}$ is independently selected from the group consisting of $CH_3$, H, F, Cl and Br, and n is from 0 to 2; and (9)

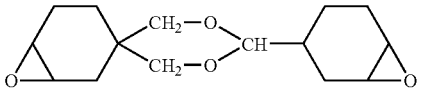

The curing agent component may preferably comprise a compound represented by the structural formula (4):

(4)

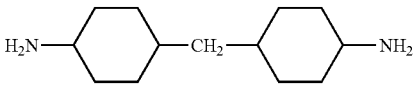

The curing agent component may preferably comprise one or more of the compounds represented by the structural formulas (5) and (8):

(5)

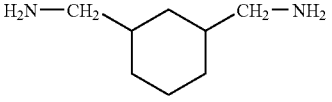

-continued (8)

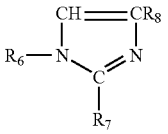

wherein each of $R_6$, $R_7$ and $R_8$ is independently a $C_{1-18}$ alkyl group or H.

The composition of the present invention may further comprise a filler and a refractory material. The refractory material may preferably comprise at least one of magnesium hydroxide and aluminum hydroxide. Magnesium hydroxide may be more preferably magnesium hydroxide obtained from seawater magnesium.

The density-increasing agent may be preferably a metal powder having a density of 5.0 to 22.5 g/cm$^3$, a metal oxide powder having a density of 5.0 to 22.5 g/cm$^3$, or a combination thereof.

The present invention can further provide a neutron shielding material and a neutron shielding container obtainable from the above-described neutron shielding material composition.

BEST MODE FOR CARRYING OUT THE INVENTION

Figure 1:
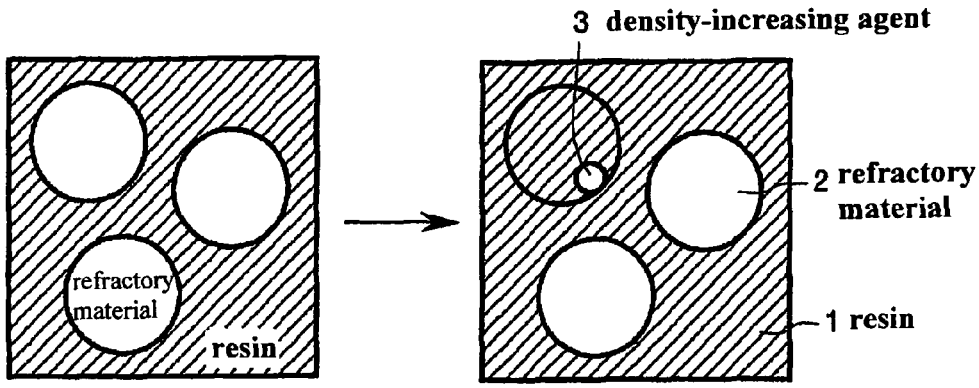
FIG. 1 is a conceptual view showing an embodiment of the neutron shielding material composition of the present invention.

Embodiments of the present invention will be described in detail below. The embodiments described below do not limit the present invention. Throughout the present invention, a hydrogenated bisphenol resin refers to a resin containing a polymer formed of a hydrogenated bisphenol A (2,2-bis(4'-(hydroxyphenyl)propane)) or a hydrogenated bisphenol F as a monomer. Examples of such a resin may include an epoxy resin and a polycarbonate resin. Specific examples may include a bisphenol A epoxy acrylate resin and a bisphenol A epoxy methacrylate resin. An epoxy component refers to a compound having an epoxy ring (hereinafter referred to as epoxy compound), and may comprise one epoxy compound or a mixture of two or more epoxy compounds. A curing agent component refers to one or more curing agents. A resin component refers to a combination of a hydrogenated bisphenol resin with a curing agent component, or a combination of an epoxy component with a curing agent component.

In a conventional epoxy neutron shielding material, an amine compound mainly used as a curing agent component has particularly inferior heat resistance. This is because the bond is easily decomposed in the amine moiety of the cured resin under high-temperature conditions. The epoxy component in a conventional composition, however, has a low hydrogen content. Consequently, the composition contains a large amount of an amine curing agent having a high hydrogen content and low heat resistance to compensate the lack of the hydrogen content, whereby the necessary hydrogen content is ensured.

Accordingly, the present invention provides a composition comprising, as a resin component, a hydrogenated bisphenol resin having a relatively high hydrogen content and a rigid structure. The present invention also provides the composition with high heat resistance and with an epoxy component having an increased hydrogen content, wherein the epoxy resin component comprises use of a compound having relatively high hydrogen content and a rigid structure or crosslinking structure.

Still another embodiment of the present invention provides the composition with improved heat resistance and with only a small moiety to be decomposed by using a compound having a rigid structure as an amine curing agent and suppressing the ratio of the amine component in the whole resin composition. Yet another embodiment of the present invention provides the composition exhibiting an improved effect of moderating neutrons by use of an epoxy component having a high hydrogen content and a curing agent component having a high hydrogen content.

The present invention can provide a composition comprising a hydrogenated bisphenol resin, a curing agent component, a boron compound as a neutron absorbent, a density-increasing agent, and a refractory material. More preferably, the present invention can provide a composition with excellent heat resistance and a high neutron shielding effect having a high hydrogen content, which comprises an epoxy component containing a hydrogenated bisphenol epoxy as a main component, a curing agent component, a boron compound as a neutron absorbent, a density-increasing agent, and a refractory material. Specifically, the composition of the present invention is cured into a resin, the resin may be required to have a temperature of 330° C. or more, and preferably 350° C. or more at which 90 wt % by weight of the resin remains by thermogravimetric analysis, and to have a hydrogen content of 9.8 wt % or more based on the total resin component. In addition to the above, more specifically, the cured resin having been subjected to thermal endurance at a high-temperature in a sealed environment for a long period can preferably keep a weight reduction and compressive strength as small as possible. For example, the cured resin after thermal endurance in a sealed environment at 190° C. for 1,000 hours may be required to keep a weight reduction not more than 0.5 wt %, preferably not more than 0.2 wt %, and to have compressive strength not being reduced, most preferably being increased instead.

Each component will be described below. In the following description, an embodiment in which an epoxy component is used as a resin component will be particularly described. A hydrogenated bisphenol resin other than the above-described epoxy component, however, may be used as a resin component in the present invention.

As the epoxy component of the present invention, an epoxy compound having an epoxy ring which can be cured with an amine curing agent can be used. The epoxy component may be one epoxy compound or a mixture of a plurality of epoxy compounds. The type or composition of the epoxy compound forming the epoxy component is selected so that the epoxy component can impart desired properties such as increased heat resistance and hydrogen content.

To increase crosslinking density and improve heat resistance, the epoxy compound may be particularly preferably a compound having a plurality of epoxy rings. Additionally, when the epoxy compound contains many ring structures such as benzene rings, the compound has a rigid structure, and thus is suitable for improving heat resistance. Further, the compound may be required to have a high hydrogen content in order to moderate neutrons.

The ring structure may preferably comprise a hydrogenated benzene ring, because a benzene ring is rigid and exhibits excellent heat resistance, but has only a low hydrogen content. The rigid structure that can impart heat resistance is preferably a structure containing the structural formula (10):

(10)

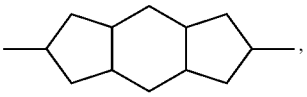

but is more preferably a structure containing the structural formula (11):

(11)

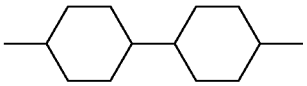

if taking a high hydrogen content into consideration.

Taking these points into consideration, a hydrogenated bisphenol epoxy represented by the structural formula (1), for example, a hydrogenated bisphenol A epoxy or hydrogenated bisphenol F epoxy may be most suitable for the epoxy component in the composition of the present invention in terms of hydrogen content and heat resistance. Accordingly, the epoxy component of the present invention may comprise the structural formula (1) as an essential component.

Further, the structural formula (3) or the structural formula (6) may be added as an epoxy component for imparting heat resistance. The structural formula (2) may be added as a component for improving heat resistance and hydrolysis resistance. Since the structural formula (9) retains the high hydrogen content and is expected to exhibit heat resistance, desirable properties can be imparted by adding this compound as an epoxy component. Accordingly, the epoxy component of the present invention may comprise all of the structural formulas (2), (3), (6), and (9), or may comprise only one of the structural formulas. One or more of these structural formulas may be selected according to viscosity of the composition or cost. The epoxy component of the present invention may comprise a hydrogenated bisphenol epoxy as a main component, and may comprise the structural formulas (2), (3), (6), and (9) in any possible combination of two or more.

For example, the epoxy component of the present invention can be prepared by adding, to a compound of the structural formula (1), a combination of compounds of the structural formulas (2) and (3), a combination of compounds of the structural formula (2) and (6), a combination of compounds of the structural formula (2) and (9), a combination of compounds of the structural formula (3) and (6), a combination of compounds of the structural formula (3) and (9), a combination of compounds of the structural formula (6) and (9), a combination of compounds of the structural formula (2), (3), and (6), a combination of compounds of the structural formula (2), (3), and (9), a combination of compounds of the structural formula (2), (6), and (9) or a combination of compounds of the structural formula (3), (6), and (9).

The epoxy component of the present invention comprising, as a main component, a hydrogenated bisphenol A epoxy of the structural formula (1), wherein $R_1$ to $R_4$ each represents a methyl group and n is from 0 to 2, can have a high hydrogen content and high heat resistance together in a suitable manner by itself, advantageously. A hydrogenated bisphenol F epoxy of the structural formula (1), wherein $R_1$ to $R_4$ are hydrogen and n is from 0 to 2, has a low viscosity, and is thus advantageously used in a mixture with a flaky epoxy of the structural formula (2). When the compound of the structural formulas (3), (6), and (9) are further added to the hydrogenated bisphenol F epoxy and a compound of the structural formula (2), a multi-component system having high heat resistance can be expected.

One example of the epoxy component of the present invention may be an epoxy component comprising a hydrogenated bisphenol F epoxy and one or more compounds of the structural formula (2). In this case, the epoxy component may preferably have a composition in which one or more compounds of the structural formula (1) are 35 wt % to 90 wt % and one or more compounds of the structural formula (2) are 10 wt % to 65 wt %, respectively based on the total epoxy content. More preferably, the epoxy component may have a composition in which one or more compounds of the structural formula (1) are 50 wt % to 80 wt % and one or more compounds of the structural formula (2) are 20 wt % to 50 wt %, respectively based on the total epoxy content.

The composition of the epoxy component can be determined so that the resin component contains sufficient amount of hydrogens for shielding neutrons, and preferably in an amount of 9.8 wt % or more. Neutron shielding performance of the neutron shielding material can be determined according to hydrogen content (density) of the neutron shielding material and thickness of the neutron shielding material. This value can be based on the hydrogen content required for the resin component, which is calculated with respect to the hydrogen content (density) required for the neutron shielding material, determined from neutron shielding performance required for a cask and the designed thickness of the neutron shield in the cask, taking into consideration the amounts of the refractory material or the neutron absorbent mixed to the neutron shielding material. Here, the epoxy component may comprise the structural formula (1) in an amount of preferably 35 wt % or more, more preferably 50 wt % or more, and most preferably 100 wt %.

When the epoxy component comprises the structural formula (3), the content thereof in the epoxy component may be preferably 50 wt % or less, more preferably 30 wt % or less. When the epoxy component comprises a bisphenol epoxy represented by the structural formula (6), the content thereof may be preferably 50 wt % or less, more preferably 30 wt % or less.

The compound represented by the structural formula (2) for imparting hydrolysis resistance and heat resistance may be added to the epoxy component in an amount of preferably 65 wt % or less, more preferably 50 wt % or less, still more preferably 30 wt % or less. This is because, if too large an amount of the structural formula (2) is added, viscosity may be increased, and it may be impossible to add a refractory material or the like. When the epoxy component comprises a hydrogenated bisphenol F epoxy as a main component, an increase in viscosity can be suppressed, and this is effective if a large amount of the structural formula (2) is added, accordingly. For example, the epoxy component comprising a hydrogenated bisphenol F epoxy as a main component and about 50 wt % of the structural formula (2) can have the same viscosity as in the epoxy component comprising a hydrogenated bisphenol A epoxy as a main component and about 35 wt % of the structural formula (2).

As the curing component in the present invention which is reacted with the epoxy component to form a crosslinked structure, an amine compound can be used. To increase the crosslinking density, a compound having a plurality of amino groups may be preferably used. To further impart heat resistance, a curing agent component having one or more ring structures, and preferably two or more ring structures may be used. To further impart a neutron shielding effect, a compound having a high hydrogen content may be preferable. Preferable ring structures may include hydrocarbon cyclic structures such as a benzene ring, hexane ring and naphthalene ring; heat-stable 5- or 6-membered rings such as heterocyclic rings and a structure obtained by bonding these rings; and a complex cyclic structure containing these structures.

Many such curing agents are described in various documents, and any of the curing agents can be applied taking into consideration the necessary amount thereof added stoichiometrically derived from the epoxy equivalent of the epoxy component, the hydrogen content, and the like. Menthenediamine, isophoronediamine, 1,3-diaminocyclohexane and the like can be used from the viewpoint of the hydrogen content, heat resistance, viscosity and the like. In particular, an amine compound having two ring structures, specifically, the structural formula (4) is preferably used in terms of heat resistance. The structural formula (5) can be added to the structural formula (4) as a by-component. Even a small amount of the structural formula (8) added functions as a curing agent and also functions as a curing promoter. Thus, the structural formula (8) is effective in reducing the amount of a curing agent component.

When the curing agent component comprises two or more sub-components comprising the structural formula (4), for example, when the curing agent component contains two amine compounds of the structural formulas (4) and (5), the amine of the structural formula (4) may be added in an amount of preferably 80 wt % or less, more preferably 60 wt % or less based on the total curing agent component.

The curing agent component may be added in an amount of preferably 25 wt % or less, more preferably 23 wt % or less based on the total resin component. However, the necessary amount to be added can be stoichiometrically derived from the epoxy equivalent of the epoxy component.

The density-increasing agent may be any material that is dense and can increase the specific gravity of the neutron shield, unless the material adversely affects other components. Here, the density-increasing agent itself which effectively shields γ-rays may have a density of 5.0 g/cm$^3$ or more, preferably 5.0 to 22.5 g/cm$^3$, more preferably 6.0 to 15 g/cm$^3$. If the density is less than 5.0 g/cm$^3$, it may be difficult to effectively shield γ-rays without impairing neutron shielding capability. If the density is more than 22.5 g/cm$^3$, an effect in proportion to the amount added cannot be observed.

Specific examples of the density-increasing agent may include metal powders and metal oxide powders. Preferable examples of the density-increasing agent may include metals having a melting point of 350° C. or more such as Cr, Mn, Fe, Ni, Cu, Sb, Bi, U and W; and metal oxides having a melting point of 1,000° C. or more such as NiO, CuO, ZnO, $ZrO_2$, SnO, $SnO_2$, $WO_2$, $UO_2$, PbO, $WO_3$ and lanthanoid oxides. Of these, Cu, $WO_2$, $WO_3$, $ZrO_2$ and $CeO_2$ may be particularly preferable. This is because they are advantageous in terms of cost. The density-increasing agent may be used singly or in a mixture of two or more.

There are no specific limitations to the particle size of the density-increasing agent. However, if the particle size is large, the density-increasing agent may settle during manufacturing process. Therefore, the particle size may be preferably small to the extent that settling does not occur. The particle size that does not cause settling may largely depend on other conditions (for example, the temperature, viscosity, curing speed and the like of the composition), and thus cannot be numerically defined simply.

By adding a density-increasing agent, the specific gravity of a neutron shield can be increased, and γ-rays can be more effectively shielded. By use of the above-described metal powder or metal oxide powder, fire resistance can also be improved.

By replacing a part of an additive other than the resin component, mainly a part of the refractory material with the density-increasing agent, the hydrogen content may be increased. By replacing mainly a part of the refractory material with the density-increasing agent, the amount of the epoxy resin can be increased while maintaining a specific gravity of a neutron shielding material composition (1.62 to 1.72 g/cm$^3$). Thus, a neutron shield having a high hydrogen content can be manufactured, and neutrons can be effectively shielded. Specifically, neutron shielding capability and γ-ray shielding can be achieved at the same time.

The amount of the density-increasing agent to be added can be appropriately adjusted to maintain the specific gravity of the neutron shielding material composition (1.62 to 1.72 g/cm$^3$). It is difficult to specifically define the amount, because the amount varies according to the type of the density-increasing agent used, the types and contents of other components, and the like. For example, the amount is 5 to 40 mass %, and preferably 9 to 35 mass % based on the total neutron shielding material composition. The amount is particularly preferably 15 to 20 mass % when using $CeO_2$. If the amount is less than 5 mass %, it is difficult to observe the effect of adding the density-increasing agent. If the amount is more than 40 mass %, it is difficult to keep the specific gravity of the neutron shielding material composition in the range of 1.62 to 1.72 g/cm$^3$.

Examples of a boron compound added as the neutron absorbent may include boron carbide, boron nitride, boric acid anhydride, boron iron, colemanite, orthoboric acid and metaboric acid. Boron carbide may be most preferable.

A powder can be used as the above-described boron compound without specific limitations to its particle size and amount added. When considering dispersibility in the epoxy resin of the matrix resin component and neutron shielding performance, the average particle size may range from preferably about 1 to 200 microns, more preferably about 10 to 100 microns, particularly preferably about 20 to 50 microns. On the other hand, the amount of the boron compound added may range from most preferably 0.5 to 20 wt % based on the total composition including the filler described below. If the amount is less than 0.5 wt %, the boron compound added may exhibit only a small effect as the neutron shielding material. If the amount is more than 20 wt %, it may be difficult to homogeneously disperse the boron compound.

In the present invention, the filler may include a powder such as silica, alumina, calcium carbonate, antimony trioxide, titanium oxide, asbestos, clay, mica; or a glass fiber-. A carbon fiber or the like may be added if necessary. Further, if necessary, a releasing agent such as a natural wax, metallic salt of fatty acid, acid amides, or fatty acid esters; a flame retardant such as paraffin chloride, bromotoluene, hexabromobenzene, or antimony trioxide; a colorant such as carbon black, or iron oxide red; a silane coupling agent; a titanium coupling agent; or the like can be added.

The refractory material used in the composition of the present invention aims to preserve a certain amount or more of the neutron shielding material so that neutron shielding capability can be maintained to a certain extent or higher even in case of fire. As such a refractory material, magnesium hydroxide or aluminum hydroxide is preferable. Of these, magnesium hydroxide may be particularly preferable, because it is present in a stable manner even at a high temperature of 170° C. or more. Magnesium hydroxide may be preferably magnesium hydroxide obtained from seawater magnesium. This is because magnesium in seawater has a high purity to make the hydrogen ratio in the composition relatively high. Seawater magnesium can be produced by a method such as a seawater method or ionic brine method. Otherwise, a commercially available product Kisuma 2SJ (product name, Kyowa Chemical Industry Co., Ltd.) may be purchased and used. However, commercially available magnesium hydroxide is not limited to this product. The refractory material may be added in an amount of preferably 20 to 70 wt %, particularly preferably 35 to 60 wt % based on the total composition.

The composition of the present invention may be prepared by mixing epoxy components; then allowing the mixture to stand at room temperature; mixing a curing agent component with the mixture when the mixture is at about room temperature; and finally adding a density-increasing agent, a refractory material, a neutron absorbent and other additive components. Polymerization may be carried out at room temperature, but may be preferably carried out by heating. Although polymerization conditions may differ according to the composition of the resin component, heating may be preferably carried out at a temperature of 50° C. to 200° C. for 1 to 3 hours. Further, such heating treatment may be preferably carried out in two stages. It is preferable to carry out heating treatment at 60° C. to 90° C. for 1 to 2 hours, and then at 120° C. to 150° C. for 2 to 3 hours.

A cask for storing and transporting a spent nuclear fuel can be produced using the above composition. Such a transportation cask can be produced by a known art. For example, in a cask disclosed in Japanese Patent Application Unexamined Publication No. 2000-9890, a location to be filled with a neutron shield is provided. Such a location can be filled with the composition of the present invention.

The composition of the present invention can be used not only for such a neutron shield, but also for various places in apparatuses and facilities to prevent diffusion of neutrons, and can effectively shield neutrons.

Specific examples of embodiments of the present invention using a resin component, a density-increasing agent and a refractory material will be further described in detail with reference to the drawings. Here, embodiments in which a boron compound or a filler is not added will be described for illustration, however, it should be construed that the present invention is limited to such embodiments.

First Embodiment

FIG. 1 is a conceptual view showing a configuration example of the neutron shield of the present embodiment. Specifically, as shown in FIG. 1, the neutron shield of the present embodiment is obtained by mixing a resin component 1 containing a hydrogenated bisphenol resin and a curing agent component with a refractory material 2 and a density-increasing agent 3 having a higher density than that of the refractory material 2.

Here, the neutron shield is provided with an increased hydrogen content while maintaining the material density (in the range of 1.62 to 1.72 g/mL), by mixing a metal powder or metal oxide powder as the density-increasing agent 3, in particular. Density of the density-increasing agent 3 to be mixed is 5.0 g/mL or more, ranges from preferably 5.0 to 22.5 g/mL, more preferably 6.0 to 15 g/mL. Further, the density-increasing agent 3 to be mixed is preferably a metal powder having a melting point of 350° C. or more or a metal oxide powder having a melting point of 1,000° C. or more. Examples of a powder material corresponding to the density-increasing agent include metals such as Cr, Mn, Fe, Ni, Cu, Sb, Bi, U and W. Further examples thereof include metal oxides such as NiO, CuO, ZnO, $ZrO_2$, SnO, $SnO_2$, $WO_2$, $CeO_2$, $UO_2$, PbO, PbO and $WO_3$.

Since the neutron shield of the present embodiment configured as above can be prepared by mixing the resin component 1, the refractory material 2, and the density-increasing agent 3 having a higher density than that of the refractory material 2, the neutron shield can have an increased hydrogen content while maintaining the material density at a certain value (in the range of 1.62 to 1.72 g/mL). Specifically, the refractory material 2 may have a slightly higher density and a slightly lower hydrogen content as compared with the resin component 1. Thus, a part of the refractory material 2 is replaced with the density-increasing agent 3 not containing hydrogen to make the material density equal. By calculating the density and the hydrogen content of each component and carrying out appropriate replacement, the refractory material 2 having a slightly lower hydrogen content is replaced with the resin component 1 having a high hydrogen content, so that the neutron shield can have an increased hydrogen content.

As a result, the neutron shield can provide increased neutron dosage while maintaining secondary γ-ray shielding performance, and accordingly can have improved neutron radiation shielding performance without placing a structure for shielding γ-rays outside the main body of the neutron shield as in a conventional manner.

In the neutron shield of the present embodiment, the density-increasing agent 3 to be mixed may have a density of 5.0 g/mL or more, preferably 5.0 to 22.5 g/mL, more preferably 6.0 to 15 g/mL. Therefore, the neutron shield can exhibit the above-described effect more significantly.

Figure 2:
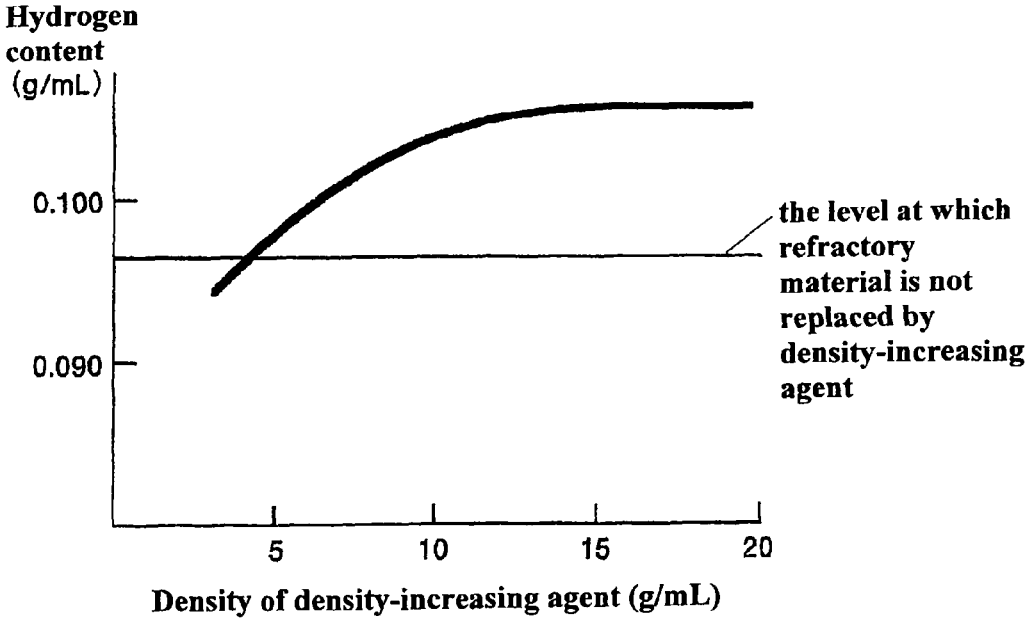
FIG. 2 is a characteristic view showing the relation between the density-increasing agent and the hydrogen content in the neutron shielding material composition of the present invention.

FIG. 2 is a characteristic view showing the relation between the density of the density-increasing agent 3 and the hydrogen content. FIG. 2 shows hydrogen contents by changing the original neutron shield having a hydrogen content of 0.0969 g/mL, containing magnesium hydroxide as the refractory material 2 and containing the resin component 1 having a density of 1.64 g/mL, to the shields in which the refractory material 2 is replaced with the density-increasing agent 3 with the material density held constant. Magnesium hydroxide as the refractory material 2 has a density of 2.36 g/mL. As is clear from FIG. 2, the density-increasing agent 3 is effective only if the density of the density-increasing agent 3 reaches a density slightly higher than in the refractory material 2, not the density of the refractory material 2, although the effective density differs, depending on the types of the resin component 1 and the refractory material 2. Specifically, the density-increasing agent 3 is effective at a density of 5.0 g/mL or more, preferably 6.0 g/mL or more. If the density is more than 22.5 g/mL, an effect in proportion to the amount added cannot be observed.

Figure 3:
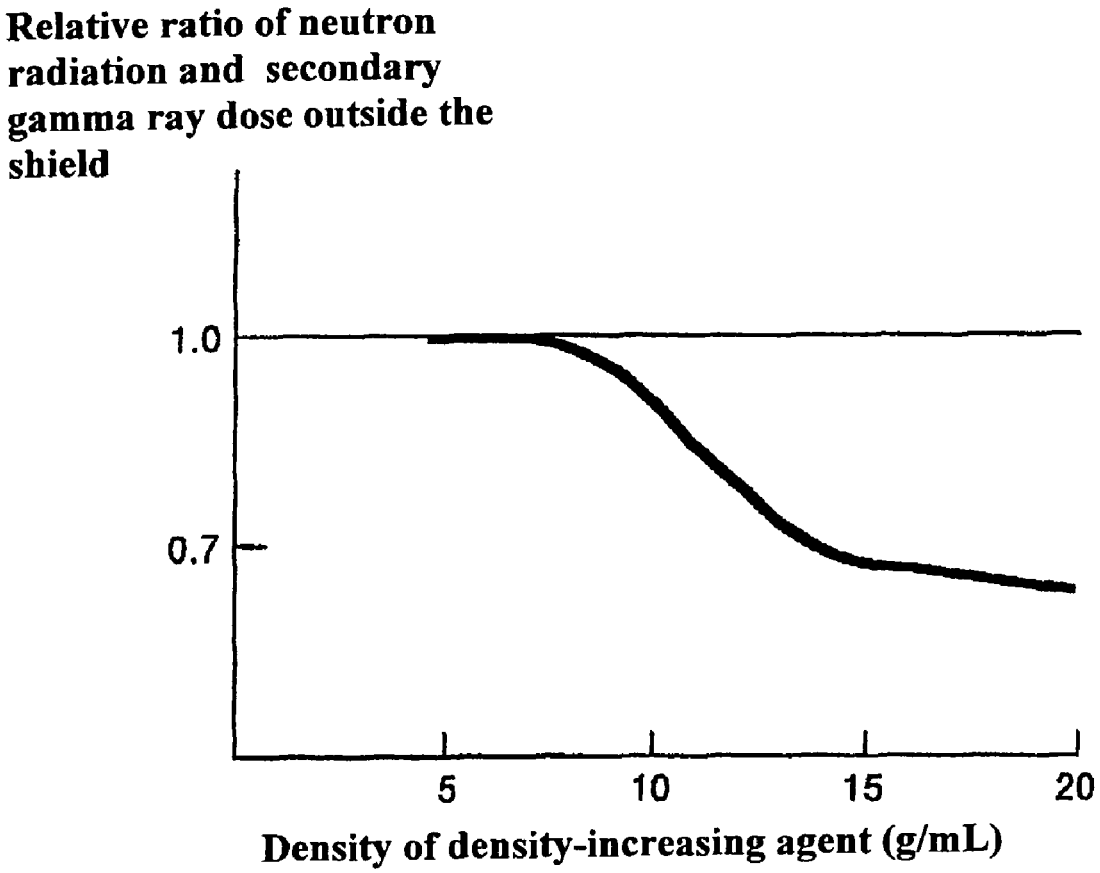
FIG. 3 is a characteristic view showing the relation between the densities of the density-increasing agent and relative values for the sum of the neutron and secondary γ-ray doses outside the neutron shield in the present invention.

FIG. 3 is a characteristic view showing the relation between the density of the density-increasing agent 3 and the relative values for the sum of the neutron and secondary γ-ray doses outside the neutron shield. FIG. 3 shows a shielding effect of the neutron shield by changing original shield having a hydrogen content of 0.0969 g/mL, containing magnesium hydroxide as the refractory material 2 and containing the base resin 1 having a density of 1.64 g/mL, to the shields in which the refractory material 2 is replaced with the density-increasing agent 3 with the material density held constant. The dose outside the shield of the resin component 1 is defined as the relative value of "1". As is clear from FIG. 3, the effect can be observed when the density-increasing agent 3 has a density of 5.0 g/mL or more, more preferably 6.0 g/mL or more. If the density is more than 22.5 g/mL, an effect in proportion to the amount added cannot be observed.

Further, the neutron shield of the present embodiment can be provided with improved fire resistance by mixing a metal powder having a melting point of 350° C. or more (such as Cr, Mn, Fe, Ni, Cu, Sb, Bi, U or W) or a metal oxide powder having a melting point of 1000° C. or more (such as NiO, CuO, ZnO, $ZrO_2$, SnO, SnO2, $WO_2$, $CeO_2$, $UO_2$, PbO, PbO or $WO_3$).

As described above, the neutron shield of the present embodiment can have an increased hydrogen content while maintaining the material density at a certain value without any decrease, and accordingly can have improved neutron shielding performance without placing a structure for shielding γ-rays outside the main body of the neutron shield as in a conventional manner.

Second Embodiment

As shown in the above FIG. 1, the neutron shield of the present embodiment is obtained by mixing a resin component 1 containing an epoxy resin and a curing agent with a refractory material 2 and a density-increasing agent 3 having a density higher than in the refractory material 2, and forming the mixture by curing.

The density-increasing agent 3 to be mixed may have a density of 5.0 g/mL or more, preferably 5.0 to 22.5 g/mL, more preferably 6.0 to 15 g/mL. Further, the density-increasing agent 3 to be mixed may be preferably a metal powder having a melting point of 350° C. or more or a metal oxide powder having a melting point of 1,000° C. or more. Examples of a powder material corresponding to the density-increasing agent may include metals such as Cr, Mn, Fe, Ni, Cu, Sb, Bi, U and W. Further examples thereof include metal oxides such as NiO, CuO, ZnO, $ZrO_2$, SnO, $SnO_2$, $WO_2$, $CeO_2$, $UO_2$, PbO, PbO and $WO_3$.

Since the neutron shield of the present embodiment configured as above is prepared by mixing the resin component 1, the refractory material 2, and the density-increasing agent 3 having a density higher than in the refractory material 2, the neutron shield can have an increased hydrogen content while maintaining the material density at a certain value (in the range of 1.62 to 1.72 g/mL). Specifically, the refractory material 2 may have a slightly higher density and a slightly lower hydrogen content as compared with the resin component 1. Thus, a part of the refractory material 2 is replaced with the density-increasing agent 3 not containing hydrogen to make the material density equal. By calculating the density and the hydrogen content of each component and carrying out appropriate replacement, the refractory material 2 having a slightly lower hydrogen content is replaced with the resin component 1 having a high hydrogen content, so that the neutron shield can have an increased hydrogen content.

As a result, the neutron shield can provide an increased neutron dosage while maintaining secondary γ-ray shielding performance, and accordingly can have improved neutron radiation shielding performance without placing a structure for shielding γ-rays outside the main body of the neutron shielding material as in a conventional manner.

In the neutron shielding material of the present embodiment, the density-increasing agent 3 to be mixed may have a density of 5.0 g/mL or more, preferably 5.0 to 22.5 g/mL, more preferably 6.0 to 15 g/mL. Therefore, the neutron shielding material can exhibit the above-described effect more significantly.

FIG. 2 is a characteristic view showing the relation between the density of the density-increasing agent 3 and the hydrogen content. FIG. 2 shows hydrogen contents by changing the original neutron shield having a hydrogen content of 0.0969 g/mL, containing magnesium hydroxide as the refractory material 2 and containing the base resin 1 having a density of 1.64 g/mL, to the shields in which the refractory material 2 is replaced with the density-increasing agent 3 with the material density held constant. Magnesium hydroxide as the refractory material 2 has a density of 2.36 g/mL. As is clear from FIG. 2, the density-increasing agent 3 is effective only if the density of the density-increasing agent 3 reaches a density slightly higher than in the refractory material 2, not the density of the refractory material 2, although the effective density differs, depending on the types of the base resin 1 and the refractory material 2. Specifically, the density-increasing agent 3 is effective at a density of 5.0 g/mL or more, more preferably 6.0 g/mL or more. If the density is more than 22.5 g/mL, an effect in proportion to the amount added cannot be observed.

FIG. 3 is a characteristic view showing the relation between the density of the density-increasing agent 3 and the relative values for the sum of the neutron and secondary γ-ray doses outside the neutron shield. FIG. 3 shows a shielding effect of the neutron shield by changing original shield having a hydrogen content of 0.0969 g/mL, containing magnesium hydroxide as the refractory material 2 and containing the base resin 1 having a density of 1.64 g/mL, to the shields in which the refractory material 2 is replaced with the density-increasing agent 3 with the material density held constant. The dose outside the shield of the base resin 1 is defined as the relative value of "1". As is clear from FIG. 3, the effect can be observed when the density-increasing agent 3 has a density of 5.0 g/mL or more, and preferably 6.0 g/mL or more. If the density is more than 22.5 g/mL, an effect in proportion to the amount added cannot be observed.

Further, the neutron shield of the present embodiment can be provided with improved fire resistance by mixing a metal powder having a melting point of 350° C. or more (such as Cr, Mn, Fe, Ni, Cu, Sb, Bi, U or W) or a metal oxide powder having a melting point of 1000° C. or more (such as NiO, CuO, ZnO, $ZrO_2$, SnO, $SnO_2$, $WO_2$, $CeO_2$, $UO_2$, PbO, PbO or $WO_3$).

As described above, the neutron shield of the present embodiment also can have an increased hydrogen content while maintaining the material density at a certain value without any decrease, and accordingly can have improved neutron shielding performance without placing a structure for shielding γ-rays outside the main body of the neutron shield as in a conventional manner. Specifically, since the neutron shield can be more effective for shielding neutrons while maintaining γ-ray shielding performance by use of a density-increasing agent, it can be less necessary to place a heavy structure for shielding γ-rays outside the main body of the neutron shield as in a conventional manner.

The present invention will be described in detail below with respect to examples. The examples below are not intended to limit the present invention.

In the examples, the composition of the present invention was prepared, and the neutron shielding effect was examined. Typically, a resin composition for a neutron shielding material is mixed with copper as a density-increasing agent, aluminum hydroxide or magnesium hydroxide as a refractory material, and a boron compound such as boron carbide as a neutron absorbent, respectively in an amount of about 20 wt %, about 40 wt % and about 1 wt % based on the total resin composition to prepare a neutron shield. Compositions without the refractory material and the neutron absorbent are mainly described here in order to evaluate properties exhibited by a resin component, specifically, an epoxy component and a curing agent component, and a density-increasing agent.

Properties required for the neutron shielding material include heat resistance (residual weight ratio, compressive strength, or the like), fire resistance and hydrogen content (the material must have a certain hydrogen content density or higher in order to be judged suitable for a neutron shield). Since fire resistance largely depends upon the refractory material, the resin composition for a neutron shielding material was evaluated for its heat resistance represented by a residual weight ratio and hydrogen content. The residual weight ratio was determined by measuring the weight change during heating to evaluate heat resistance of the composition. TGA was used for the measurement. The weight reduction by heat was measured under a condition where the composition was heated from room temperature to 600° C. at a rate of temperature rise of 10° C./min in a nitrogen atmosphere. A hydrogen content in a single resin of 9.8 wt % or more was defined as the standard hydrogen content required for the resin.

EXAMPLE 1

Mixed were 59.47 g of a hydrogenated bisphenol A epoxy resin (manufactured by Yuka Shell Epoxy K. K., YL6663 (structural formula (1))) and 25.00 g of a polyfunctional alicyclic epoxy resin (manufactured by Daicel Chemical Industries, Ltd., EHPE3150 (structural formula (2)) as epoxy resins. The mixture was maintained at 110° C., and sufficiently stirred until EHPE3150 (solid) was dissolved. After dissolution of EHPE3150, the mixture was allowed to stand in an environment at room temperature. When the temperature of the mixture fell to about room temperature, 15.53 g of 1,3-BAC (manufactured by Mitsubishi Gas Chemical Company, Inc. (structural formula (5))) was mixed therewith as a curing agent, and the mixture was stirred. Fifty gram of copper having a density of 8.92 g/$cm^3$ was mixed therewith as a density-increasing agent to prepare a resin composition used for a neutron shielding material.

The hydrogen content of the resin composition for a neutron shielding material was measured by the componential analysis. As a result of the measurement, the hydrogen content was 9.8 wt % or more (about 10 wt % or more) which was above the standard value satisfactorily. The resin composition for a neutron shielding material was cured at 80° C. for 30 minutes and at 150° C. for 2 hours, and the weight reduction by heat of the cured product was measured by TGA. As a result of measuring the weight reduction by heat, the residual weight percentage at 200° C. was 99.5 wt % or more, and the temperature at a residual weight percentage of 90 wt % was 370° C. or more, which shows extremely good heat resistance and heat stability of the composition.

EXAMPLE 2

Mixed were 48.81 g of a hydrogenated bisphenol A epoxy resin (YL6663 (structural formula (1))), 10.00 g of an alicyclic epoxy resin (manufactured by Daicel Chemical Industries, Ltd., Celloxide 2021P (structural formula (3))) and 25.00 g of a polyfunctional alicyclic epoxy resin (EHPE3150 (structural formula (2)) as epoxy resins. The mixture was kept at 110° C. and sufficiently stirred until EHPE3150 (solid) was dissolved. After dissolution of EHPE3150, the mixture was allowed to stand in an environment at room temperature. When the temperature of the mixture fell to about room temperature, 16.19 g of 1,3-BAC (structural formula (5)) was mixed therewith as a curing agent, and the mixture was stirred.

Mixed therewith was 50 g of copper as a density-increasing agent to prepare a resin composition used for a neutron shielding material.

As a result of measuring the hydrogen content in the resin composition, the hydrogen content was 9.8 wt % or more (about 10 wt % or more) which was above the standard satisfactorily. The resin composition for a neutron shielding material was cured at 80° C. for 30 minutes and at 150° C. for 2 hours to measure the weight reduction by heat. As a result, the residual weight percentage at 200° C. was 99.5 wt % or more, and the temperature at a residual weight percentage of 90 wt % was 380° C. or more, which shows extremely good heat resistance and heat stability of the composition.

EXAMPLE 3

Mixed were 49.20 g of a hydrogenated bisphenol A epoxy resin (YL6663 (structural formula (1))), 10.00 g of a bisphenol A epoxy resin (manufactured by Yuka Shell Epoxy K. K., Epicoat 828 (structural formula (6), wherein $R_9$ to $R_{12}$ each represents a methyl group, and n is from 0 to 2)) and 25.00 g of a polyfunctional alicyclic epoxy resin (EHPE3150 (structural formula (2))) as epoxy resins. The mixture was maintained at 110° C. and sufficiently stirred until EBPE3150 (solid) was dissolved. After dissolution of EHPE3150, the mixture was allowed to stand in an environment at room temperature. When the temperature of the mixture fell to about room temperature, 15.80 g of 1,3-BAC (structural formula (5)) as a curing agent was mixed therewith and stirred.

Mixed therewith was 50 g of copper as a density-increasing agent to prepare a resin composition used for a neutron shielding material.

As a result of measuring the hydrogen content in the resin composition, the hydrogen content was 9.8 wt % or more (about 9.9 wt % or more) which was above the standard value satisfactorily. On the other hand, the resin composition for a neutron shielding material was cured at 80° C. for 30 minutes and at 150° C. for 2 hours to measure the weight reduction by heat. As a result, the residual weight percentage at 200° C. was 99.5 wt % or more, and the temperature at a residual weight precentage of 90 wt % was 380° C. or more, which shows extremely good heat resistance and heat stability of the composition.

EXAMPLE 4

Mixed were 55.44 g of a hydrogenated bisphenol A epoxy resin (YL6663 (structural formula (1))) and 25.00 g of a polyfunctional alicyclic epoxy resin (EHPE3150 (structural formula (2)) as epoxy resins. The mixture was maintained at 110° C. and sufficiently stirred until EHPE3150 (solid) was dissolved. After dissolution of EHPE3150, the mixture was allowed to stand in an environment at room temperature. When the temperature of the mixture fell to about room temperature, 19.56 g of a mixed curing agent was mixed therewith and stirred, wherein the mixed curing agent was obtained by sufficiently mixing 14.67 g of Wandamin HM (manufactured by New Japan Chemical Co., Ltd. (structural formula (4))) with 4.89 g of 1,3-BAC (structural formula (5)) in advance to make the curing agents compatible with each other.

Mixed therewith was 50 g of copper as a density-increasing agent to prepare a resin composition used for a neutron shielding material.

As a result of measuring the hydrogen content in the resin composition, the hydrogen content was 9.8 wt % or more (about 10 wt % or more) which was above the standard satisfactorily. The resin composition for a neutron shielding material was cured at 80° C. for 30 minutes and at 150° C. for 2 hours to measure the weight reduction by heat. As a result, the residual weight percentage at 200° C. was 99.5 wt % or more, and the temperature at a residual weight percentage of 90 wt % was about 390° C., which shows extremely good heat resistance and heat stability of the composition.

EXAMPLE 5

Mixed were 44.62 g of a hydrogenated bisphenol A epoxy resin (YL6663 (structural formula (1))), 10.00 g of an alicyclic epoxy resin (Celloxide 2021P (structural formula (3))) and 25.00 g of a polyfunctional alicyclic epoxy resin (EHPE3150 (structural formula (2)) as epoxy resins. The mixture was maintained at 110° C. and sufficiently stirred until EHPE3150 (solid) was dissolved. After dissolution of EHPE3150, the mixture was allowed to stand in an environment at room temperature. When the temperature of the mixture fell to about room temperature, 19.38 g of a mixed curing agent was mixed therewith and stirred, wherein the mixed curing agent was obtained by sufficiently mixing 15.29 g of Wandamin HM (structural formula (4)) with 5.09 g of 1,3-BAC (structural formula (5)) in advance to make the curing agents compatible with each other.

Mixed therewith was 50 g of copper as a density-increasing agent to prepare a resin composition used for a neutron shielding material.

As a result of measuring the hydrogen content in the resin composition, the hydrogen content was 9.8 wt % or more (about 10 wt % or more) which was above the standard satisfactorily. The resin composition for a neutron shielding material was cured at 80° C. for 30 minutes and at 150° C. for 2 hours to measure the weight reduction by heat. As a result, the residual weight percentage at 200° C. was 99.5 wt % or more, and the temperature at a residual weight percentage of 90 wt % was about 400° C., which shows extremely good heat resistance and heat stability of the composition.

EXAMPLE 6

Mixed were 43.42 g of a hydrogenated bisphenol A epoxy resin (YL6663 (structural formula (1))), 13.28 g of a bisphenol A epoxy resin (Epicoat 828 (structural formula (6), wherein $R_9$ to $R_{12}$ each represents a methyl group, and n is from 0 to 2)) and 24.30 g of a polyfunctional alicyclic epoxy resin (EHPE3150 (structural formula (2))) as epoxy resins. The mixture was maintained at 110° C. and sufficiently stirred until EHPE3150 (solid) was dissolved. After dissolution of EHPE3150, the mixture was allowed to stand in an environment at room temperature. When the temperature of the mixture fell to about room temperature, 19.00 g of a mixed curing agent obtained by preliminarily mixing 11.4 g of Wandamin HM (structural formula (4)) with 7.6 g of 1,3-BAC (structural formula (5)) sufficiently and making the curing agents compatible with each other was mixed therewith, and the mixture was stirred.

Mixed therewith was 50 g of copper as a density-increasing agent to prepare a resin composition used for a neutron shielding material.

As a result of measuring the hydrogen content in the resin composition, the hydrogen content was about 9.8 wt % which satisfied the standard. The resin composition for a neutron shielding material was cured at 80° C. for 30 minutes and at 150° C. for 2 hours to measure the weight reduction by heat. As a result, the residual weight percentage at 200° C. was 99.5 wt % or more, and the temperature at a residual weight percentage of 90 wt % was 400° C. or more, which shows extremely good heat resistance and heat stability of the composition.

EXAMPLE 7

Mixed with 80.83 g of a hydrogenated bisphenol A epoxy resin (YL6663 (structural formula (1))) as an epoxy resin was 19.17 g of a mixed curing agent, wherein the mixed curing agent was obtained by sufficiently mixing 14.38 g of Wandamin HM (structural formula (4)) with 4.79 g of 1,3-BAC (structural formula (5)) in advance and stirring to make the above curing agents compatible with one another.

Mixed therewith was 50 g of copper as a density-increasing agent to prepare a resin composition used for a neutron shielding material.

As a result of measuring the hydrogen content in the resin composition, the hydrogen content was 10.6 wt % or more which was considerably above the standard, satisfactorily. The resin composition for a neutron shielding material was cured at 80° C. for 30 minutes and at 150° C. for 2 hours to measure the weight reduction by heat. As a result, the residual weight percentage at 200° C. was about 99.5 wt %, and the temperature at a residual weight percentage of 90 wt % was about 330° C., which shows extremely good heat resistance and heat stability of the composition.

EXAMPLE 8

Mixed with 69.93 g of a hydrogenated bisphenol A epoxy resin (YL6663 (structural formula (1))) and 10.07 g of an alicyclic epoxy resin (Celloxide 2021P (structural formula (3))) as epoxy resins was 20.00 g of a mixed curing agent, wherein the mixed curing agent was obtained by sufficiently mixing 15.00 g of Wandamin HM (structural formula (4)) with 5.00 g of 1,3-BAC (structural formula (5)) and stirring in advance to make the above curing agents compatible with one another.

Mixed therewith was 50 g of copper as a density-increasing agent to prepare a resin composition used for a neutron shielding material.

As a result of measuring the hydrogen content in the resin composition, the hydrogen content was about 10.5 wt % which was considerably above the standard, satisfactorily. The resin composition for a neutron shielding material was cured at 80° C. for 30 minutes and at 150° C. for 2 hours to measure the weight reduction by heat. As a result, the residual weight percentage at 200° C. was 99.5 wt % or more, and the temperature at a residual weight percentage of 90 wt % was about 340° C., which shows extremely good heat resistance and heat stability of the composition.

EXAMPLE 9

Mixed with 49.48 g of a hydrogenated bisphenol A epoxy resin (YL6663 (structural formula (1))) and 30.32 g of a bisphenol A epoxy resin (Epicoat 828 (structural formula (6), wherein $R_9$ to $R_{12}$ each represents a methyl group, and n is from 0 to 2)) as epoxy resins was 20.20 g of a mixed curing agent, wherein the mixed curing agent was obtained by sufficiently mixing 15.15 g of Wandamin HM (structural formula (4)) with 5.05 g of 1,3-BAC (structural formula (5)) in advance to make the above curing agents compatible with one another.

Mixed therewith was 50 g of copper as a density-increasing agent to prepare a resin composition used for a neutron shielding material.

As a result of measuring the hydrogen content in the resin composition, the hydrogen content was about 9.8 wt % which satisfied the standard. The resin composition for a neutron shielding material was cured at 80° C. for 30 minutes and at 150° C. for 2 hours to measure the weight reduction by heat. As a result, the residual weight percentage at 200° C. was 99.5 wt % or more, and the temperature at a residual weight percentage of 90 wt % was about 360° C., which shows extremely good heat resistance and heat stability of the composition.

EXAMPLE 10

Mixed with 16.00 g of 1,3-BAC (structural formula (5)) were 55.02 g of a hydrogenated bisphenol A epoxy resin (YL6663 (structural formula (1))) and 28.98 g of a bisphenol A epoxy resin (Epicoat 828 (structural formula (6), wherein $R_9$ to $R_{12}$ each represents a methyl group, and n is from 0 to 2)), and the mixture was stirred. Mixed therewith was 50 g of copper as a density-increasing agent to prepare a resin composition used for a neutron shielding material.

As a result of measuring the hydrogen content in the resin composition, the hydrogen content was about 9.8 wt % which satisfied the standard. The resin composition for a neutron shielding material was cured at 80° C. for 30 minutes and at 150° C. for 2 hours to measure the weight reduction by heat. As a result, the residual weight percentage at 200° C. was 99.5 wt % or more, and the temperature at a residual weight percentage of 90 wt % was about 340° C., which shows extremely good heat resistance and heat stability of the composition.

EXAMPLE 11

Mixed were 55.44 g of a hydrogenated bisphenol A epoxy resin (YL6663 (structural formula (1))) and 25.00 g of a polyfunctional alicyclic epoxy resin (EHPE3150 (structural formula (2)) as epoxy resins. The mixture was maintained at 110° C. and sufficiently stirred until EHPE3150 (solid) was dissolved. After dissolution of EHPE3150, the mixture was allowed to stand in an environment at room temperature. When the temperature of the mixture fell to about room temperature, 19.55 g of a mixed curing agent was mixed therewith and stirred, wherein the mixed curing agent was obtained by sufficiently mixing 14.5 g of Wandamin HM (structural formula (4)), 4.85 g of 1,3-BAC (structural formula (5)) and 0.2 g of an imidazole compound (structural formula (8)) in advance to make the above curing agents compatible with each other.

Mixed therewith was 50 g of copper as a density-increasing agent to prepare a resin composition used for a neutron shielding material.

As a result of measuring the hydrogen content in the resin composition, the hydrogen content was 9.8 wt % or more (about 10 wt % or more) which was above the standard satisfactorily. The resin composition for a neutron shielding material was cured at 80° C. for 30 minutes and at 150° C. for 2 hours to measure the weight reduction by heat. As a result, the residual weight percentage at 200° C. was 99.5 wt % or more, and the temperature at a residual weight percentage of 90 wt % was 390° C. or more, which shows extremely good heat resistance and heat stability of the composition.

EXAMPLE 12

Here, a composition was prepared by further adding a neutron absorbent and a refractory material.

Mixed were 43.42 g of a hydrogenated bisphenol A epoxy resin (YL6663 (structural formula (1))), 13.28 g of a bisphenol A epoxy resin (Epicoat 828 (structural formula (6), wherein $R_9$ to $R_{12}$ each represents a methyl group, and n is from 0 to 2)), and 24.30 g of a polyfunctional alicyclic epoxy resin (EHPE3150 (structural formula (2))) as epoxy resins. The mixture was maintained at 110° C. and sufficiently stirred until solid EHPE3150 was dissolved. After dissolution of EHPE3150, the mixture was allowed to stand in an environment at room temperature. When the temperature of the mixture fell to about room temperature, 19:00 g of a mixed curing agent was mixed therewith and stirred, wherein the curing agent was obtained by sufficiently mixing 11.4 g of Wandamin HM (structural formula (4)) with 7.6 g of 1,3-BAC (structural formula (5)) in advance to make the curing agents compatible with each other.

Mixed therewith were 39.0 g of copper as a density-increasing agent, 76.0 g of magnesium hydroxide and 3.0 g of boron carbide, and the mixture was stirred to prepare a composition for neutron shielding material.

The reference hydrogen content required for a neutron shielding material is a hydrogen content density of 0.096 g/cm$^3$ or more. The hydrogen content density of the prepared neutron shielding material composition was measured to be 0.096 g/cm$^3$ or more, which satisfied the standard. The resin composition for a neutron shielding material was cured at 80° C. for 30 minutes and at 150° C. for 2 hours. The cured product was subjected to the weight reduction measurement by heating. As a result, the residual weight percentage at 200° C. was 99.5 wt % or more, and the temperature at a residual weight percentage of 90 wt % was 400° C. or more, which shows extremely good heat resistance and heat stability of the composition.

The cured product was enclosed in a closed vessel, and a thermal endurance test was carried out at 190° C. for 1,000 hours. After the thermal endurance test, the compressive strength was 123 MPa and 1.1 times of that before the test; the weight reduction percentage was about 0.05%; and the glass transition temperature (tanδ peak in the viscoelasticity measurements) was increased from 130° C. as a value before the test to about 175° C. It was confirmed from the result of infrared spectroscopic analysis that the chemical structure was almost not changed before and after the test. The above results confirmed that the composition has extremely good thermal durability.

COMPARATIVE EXAMPLE 1

A bisphenol A epoxy resin (Epicoat 828 (structural formula (6), wherein $R_9$ to $R_{12}$ each represents a methyl group, and n is from 0 to 2)) as an epoxy resin was mixed with a polyamine curing agent at a mixing ratio of 1:1 (stoichiometrically equal), and the mixture was stirred to prepare a resin composition used for a neutron shielding material. No density-increasing agent was added.

As a result of measuring the hydrogen content in the resin composition, the hydrogen content was 9.8 wt % or more which satisfied the standard value. The resin composition for a neutron shielding material was cured at 80° C. for 30 minutes and at 150° C. for 2 hours. The cured product was subjected to the weight reduction measurement by heat. As a result, the residual weight percentage at 200° C. was 99 wt % or less, and the temperature at a residual weight percentage of 90 wt % was 300° C. or less, which shows heat resistance and heat stability of the composition was inferior to those of the compositions of Examples.

This composition system imitated the same system as in a conventionally used resin composition for a neutron shielding material. The composition of Comparative Example 1 was suitable in terms of hydrogen content, but had low heat resistance and heat stability as compared with those of the compositions of Examples. It was indicated that the compositions of Examples had excellent heat resistance and heat stability.

COMPARATIVE EXAMPLE 2

Sufficiently stirred were 81.4 g of a bisphenol A epoxy resin (Epicoat 828 (structural formula (6), wherein $R_9$ to $R_{12}$ each represents a methyl group, and n is from 0 to 2)) as an epoxy resin and 18.6 g of isophoronediamine as a curing agent to prepare a resin composition used for a neutron shielding material. No density-increasing agent was added.

As a result of measuring the hydrogen content in the resin composition, the hydrogen content was 8.2 wt % or less which was considerably below the standard, unsatisfactorily. The resin composition for a neutron shielding material was cured at 80° C. for 30 minutes and at 150° C. for 2 hours to measure the weight reduction by heat. As a result, the residual weight percentage at 200° C. was about 99.5 wt %, and the temperature at a residual weight percentage of 90 wt % was about 350° C., which shows good heat resistance and heat stability of the composition. This composition system had good heat resistance and heat stability, but had hydrogen content lower than those of the compositions of Examples, and thus was not suitable as a resin composition for a neutron shielding material.

COMPARATIVE EXAMPLE 3

A hydrogenated bisphenol A epoxy resin (YL6663 (structural formula (1))) as an epoxy resin was mixed with a polyamine curing agent at a mixing ratio of 1:1 (stoichiometrically equivalent), and the mixture was stirred to prepare a resin composition used for a neutron shielding material. The polyamine curing agent lacked a rigid structure with high stability, unlike the curing agent used in the composition of the present invention, and was contained in the resin composition at a high percentage. No density-increasing agent was added.

As a result of measuring the hydrogen content in the resin composition, the hydrogen content was 9.8 wt % or more (about 10 wt % or more) which was above the standard satisfactorily. The resin composition for a neutron shielding material was cured at 80° C. for 30 minutes and at 150° C. for 2 hours to measure the weight reduction by heat. As a result, the residual weight percentage at 200° C. was 99.0 wt % or less, and the temperature at a residual weight percentage of 90 wt % was 280° C. or less, which shows that heat resistance and heat stability of the composition is inferior to those of the compositions of Examples.

COMPARATIVE EXAMPLE 4

Sufficiently stirred were 81.7 g of an epoxy resin having a structure in which OH at each end of polypropylene glycol was substituted with glycidyl ether (epoxy equivalent: 190) and 18.3 g of isophoronediamine as a curing agent to prepare a resin composition used for a neutron shielding material. The epoxy resin used herein did not have a rigid structure, unlike the epoxy component of the present invention. No density-increasing agent was added.

As a result of measuring the hydrogen content in the resin composition, the hydrogen content was 9.8 wt % or more which satisfied the standard. The resin composition for a neutron shielding material was cured at 80° C. for 30 minutes and at 150° C. for 2 hours to measure the weight reduction by heat. As a result, the residual weight percentage at 200° C. was 99.5 wt % or less, and the temperature at a residual weight percentage of 90 wt % was less than about 250° C., which shows heat resistance and heat stability of the composition is extremely inferior to those of the compositions of Examples.

COMPARATIVE EXAMPLE 5

Sufficiently stirred were 78.5 g of 1,6-hexane diglycidyl ether (epoxy equivalent: 155) as an epoxy resin and 21.5 g of isophoronediamine as a curing agent to prepare a resin composition used for a neutron shielding material. No density-increasing agent was added.

As a result of measuring the hydrogen content in the resin composition, the hydrogen content was 9.8 wt % or more which satisfied the standard. The resin composition for a neutron shielding material was cured at 80° C. for 30 minutes and at 150° C. for 2 hours to measure the weight reduction by heat. As a result, the residual weight percentage at 200° C. was 99.5 wt % or less, and the temperature at a residual weight percentage of 90 wt % was less than 300° C., which shows heat resistance and heat stability of the composition is inferior to those of the compositions of Examples.

COMPARATIVE EXAMPLE 6

Here, the neutron shielding effect of a composition made of an epoxy component and a polyamine curing agent with a refractory material and a neutron absorbent further added was evaluated. 50 g of a bisphenol A epoxy resin (Epicoat 828 (structural formula (6), wherein $R_9$ to $R_{12}$ each represents a methyl group, and n is from 0 to 2)) as an epoxy resin was mixed with 50 g of a polyamine curing agent (so that the components were stoichiometrically equal), and the mixture was stirred. 146.5 g of magnesium hydroxide and 3.5 g of boron carbide were mixed therewith, and the mixture was stirred to prepare a resin composition used for a neutron shielding material. No density-increasing agent was added.

The reference hydrogen content required for a neutron shielding material is a hydrogen content density of 0.096 g/cm$^3$ or more. The hydrogen content density of the prepared neutron shielding material composition was measured to be 0.096 g/cm$^3$ or more, which satisfied the standard. The resin composition for a neutron shielding material was cured at 80° C. for 30 minutes and at 150° C. for 2 hours to measure the weight reduction by heat. As a result, the residual weight percentage at 200° C. was 99 wt % or less, and the temperature at a residual weight percentage of 90 wt % was 300° C. or less, which shows that heat resistance and heat stability of the composition is inferior to those of the compositions of Examples. The cured product was enclosed in a closed vessel, and a thermal endurance test was carried out at 190° C. for 1,000 hours. The compressive strength was decreased by 30% or more as compared with that before the test, which shows that the composition has low durability under a high-temperature environment.

This composition system imitated the same system as in a currently used neutron shielding material composition. The composition of Comparative Example 6 was suitable in terms of the hydrogen content, but had heat resistance and heat stability lower than those of the composition of Example 12, which shows that the composition of Example 12 exhibits excellent heat stability and heat resistance.

Since the neutron shielding material of the present invention employs an epoxy component and a curing agent with improved heat resistance, the material has good heat resistance and can endure long-term storage of spent nuclear fuels. In addition, the material has ensured neutron shielding capability. Further, since the composition of the present invention comprises a density-increasing agent, the neutron shielding material can provide an increased neutron dosage while maintaining secondary γ-ray shielding performance, and accordingly can have improved neutron shielding performance without placing a structure for shielding γ-rays outside the main body of the neutron shielding material as in a conventional manner.

The invention claimed is:

1. A neutron shielding material composition comprising:

a hydrogenated bisphenol resin;

a refractory material having higher density than that of the hydrogenated bisphenol resin;

a density-increasing agent having higher density than that of the refractory material;

a curing agent component;

a boron compound, wherein said neutron shielding material composition maintains the density of a base resin comprising said curing agent component and the refractory material; and wherein density of the neutron shielding material composition is from 1.62 g/cm$^3$ to 1.72 g/cm$^3$.

2. A neutron shielding material composition comprising a hydrogenated bisphenol epoxy represented by the following structural formula (1):

(1)

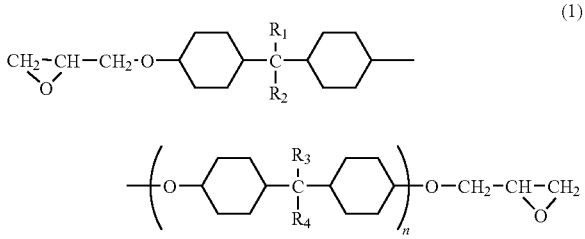

wherein each of $R_1$ to $R_4$ is independently selected from the group consisting of $CH_3$, H, F, Cl and Br, and n is from 0 to 2;

a refractory material having higher density than that of the hydrogenated bisphenol resin;

a curing agent component having at least one ring structure and a plurality of amino groups;

a density-increasing agent having higher density than that of the refractory material;

a boron compound, wherein said neutron shielding material composition maintains the density of a base resin comprising said curing agent component and the refractory material; and wherein density of the neutron shielding material composition is from 1.62 g/cm$^3$ to 1.72 g/cm$^3$.

3. The neutron shielding material composition according to claim 1, further comprising one or more compounds selected from the group consisting of compounds represented by the structural formulas (2), (3), (6) and (9):

(2)

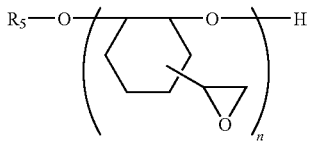

wherein $R_5$ is a (C1-10 alkyl group or H, and n is 1mm 1 to 24;

(3)

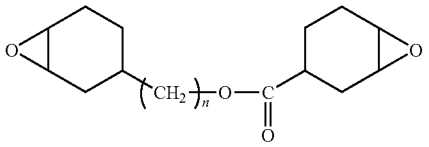

wherein n is from 1 to 8;

(6)

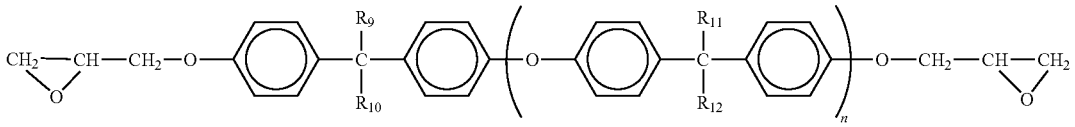

wherein each of $R_9$ to $R_{12}$ is independently selected from the group consisting of $CH_3$, H, F, Cl and Br, and n is from 0 to 2; and (9)

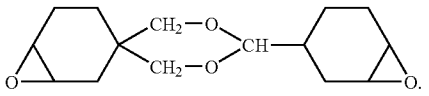

4. The neutron shielding material composition according to claim 1, comprising, as the curing agent component, a compound represented by the structural formula (4):

(4)

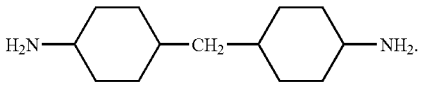

5. The neutron shielding material composition according to claim 1, wherein the curing agent component comprises one or more of compounds represented by the structural formulas (5) and (8):

(5)

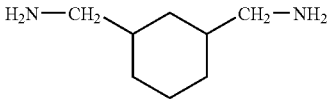

(8)

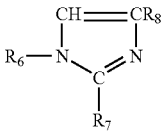

wherein $R_6$, $R_7$ and $R_8$ each is independently a C1-18 alkyl group or H.

6. The neutron shielding material composition according to claim 1, further comprising a filler.

7. The neutron shielding material composition according to claim 1, wherein the refractory material comprises at least one of magnesium hydroxide and aluminum hydroxide.

8. The neutron shielding material composition according to claim 1 or claim 2, wherein the density-increasing agent is a metal powder having a density of 5.0 to 22.5 g/cm$^3$, a metal oxide powder having a density of 5.0 to 22.5 g/cm$^3$, or a combination thereof.

9. A neutron shielding material obtained from the neutron shielding material composition according to claim 1 or claim 2.

10. A neutron shielding container obtained from the neutron shielding material composition according to claim 1 or claim 2.

11. The neutron shielding material composition according to claim 7, wherein said magnesium hydroxide is obtained from sea water magnesium.

* * * * *

UNITED STATES PATENT AND TRADEMARK OFFICE

CERTIFICATE OF CORRECTION

PATENT NO. : 7,803,288 B2
APPLICATION NO. : 10/588331
DATED : September 28, 2010
INVENTOR(S) : Noriya Hayashi et al.

It is certified that error appears in the above-identified patent and that said Letters Patent is hereby corrected as shown below:

Column 23:
Line 31, "(C1-10" should be --C1-10--.
Line 31, "1mm" should be --from--.

Signed and Sealed this

Thirtieth Day of November, 2010

David J. Kappos

David J. Kappos
*Director of the United States Patent and Trademark Office*